US005235319A

United States Patent [19]

Hill et al.

[11] Patent Number: 5,235,319

[45] Date of Patent: Aug. 10, 1993

[54] PATIENT MONITORING SYSTEM

[75] Inventors: Joseph C. Hill, 41 High Ridge Rd., Boxford, Mass. 01921; Albert P. Hill, Beverly, Mass.

[73] Assignee: Joseph C. Hill, Boxford, Mass.

[21] Appl. No.: 881,415

[22] Filed: May 11, 1992

[51] Int. Cl.[5] ..... G08B 21/00

[52] U.S. Cl. ..... 340/573; 307/125; 340/568; 340/686

[58] Field of Search ..... 340/573, 686, 666, 568; 307/125

[56] References Cited

U.S. PATENT DOCUMENTS

| | | | |
|---|---|---|---|
| 3,926,177 | 12/1975 | Hardaray, Jr. et al. | 340/573 |
| 3,991,746 | 11/1976 | Hanna | 340/573 |
| 4,179,692 | 12/1979 | Vance | 340/573 |
| 4,228,426 | 10/1980 | Roberts | 340/573 |
| 4,293,852 | 10/1981 | Rogers | 340/568 |
| 4,633,237 | 12/1986 | Trucknott et al. | 340/573 |
| 4,638,307 | 1/1987 | Swartout | 340/573 |
| 4,700,180 | 10/1987 | Vance | 340/573 |
| 4,796,013 | 1/1989 | Yasuda et al. | 340/573 |
| 4,907,845 | 3/1990 | Wood | 340/573 |
| 4,947,152 | 8/1990 | Hodges | 340/666 |

*Primary Examiner*—Glen Swann

[57] ABSTRACT

A capacitor sensor device for use in conjunction with a monitoring circuit system and call alarm system to perceive a patient movement employs a plurality of elongated electrical conductor devices positioned in horizontal parallel spaced relationship, an electrical insulating material forming an upper layer and lower layer over an about each electrical conductor device whereby the conductor devices are maintained in insulated parallel spaced relationship to each other, and a pair of electrical conductive connectors connected to alternate electrical conductor devices. The sensor device is constructed and arranged so as to be thin and flexible and formed in a selected configuration. In another embodiment, the capacitor sensor device can be used to activate a transmitter for a limited range paging system for a home application.

12 Claims, 6 Drawing Sheets

PATIENT MONITORING SYSTEM

FIELD OF THE INVENTION

This invention relates generally to monitoring systems and more particularly to a patient monitoring system that employs an automatic capacitor sensor device to provide an alert signal when a patient has started to rise from a bed or chair, for example, and before the patient has left or fallen, or to detect the absence of a patient. The invention has particular applicability in facilities that care for persons who can wander from their bed into the halls and possibility outside.

DESCRIPTION OF THE PRIOR ART

Patient monitoring systems for detecting the undesired movement of a bed restricted patient, the vacation or absence of the patient from the bed or for monitoring the body conditions of the patient in the bed are well known. However, such systems have inherent problems and difficulties well known to all who use them.

One disadvantage of prior art patient monitoring systems is that since the electric fields are restricted to the region between the plates of a capacitor, the only portion of the electric field that can be modified by the presence of the patient is the field at the perimeter of the capacitor.

Another disadvantage of other present patient monitoring systems is that they require mechanical pressure to produce a change in capacitance to indicate patient movement which has a disadvantage in that a heavy object cannot be distinguished from a patient.

Another disadvantage of prior art patient monitoring systems is the need for a patient monitoring system device which is of relatively simple construction and which may be economically manufactured.

The following U.S. Patents are believed to exemplify the present state of the art with respect to patient monitoring systems:

| | | |
|---|---|---|
| 3,991,746 | 3,926,177 | 4,179,692 |
| 4,228,426 | 4,633,237 | 4,638,307 |
| 4,700,180 | 4,796,013 | 4,907,845 |

While such prior art devices provide improvements in the areas intended, there still exists a need for a patient monitoring system which overcomes the disadvantages of the prior art while providing a patient monitoring system which provides new and useful advantageous and improvements not heretofore disclosed.

Accordingly, a principal object of the present invention is to provide a new and improved patient monitoring system which overcomes the disadvantages of the prior art devices.

Another object of the present invention is to provide a patient monitoring system for notifying or sounding an alarm when a patient associated with the monitoring system attempts to get up from or leave a bed or chair.

A still further object of the present invention is to provide a capacitor sensor device which is substantially thin and flexible.

A still further object of the present invention is to provide a patient monitoring system with the foregoing desirable objects and which may be economically manufactured and be of durable character.

These and other desirable objects of the present invention will in part appear hereinafter and will in part become apparent after consideration of the specification with reference to the drawings and the claims.

SUMMARY OF THE INVENTION

The present invention comprises a new and improved monitoring system for automatically and remotely indicating, at a nursing station, the movement or absence of a person from a remote predetermined location, such as, for example, a hospital bed or chair in a hospital room. The present invention can utilize existing "call button" wiring in a care facility.

The monitoring system of the present invention comprises a capacitive proximity sensor device which provides for sensing the movement of a patient in a predetermined location such as a bed or chair. The range of sensitivity of the sensor device is in the order a few tenths of an inch whereby it will detect when a patient has started to rise and before the patient has left a bed or chair and providing notification of the same to the nursing staff, for example. A feature of the sensing device is that bed clothing and rubber sheets, for example, may be put between the sensor device and the patient without affecting its operation. The sensor device is constructed and arranged so as to be thin and flexible and formed in a selected configuration. Additionally, the sensor device includes circuitry means whereby the sensor device can be electrically connected to an existing electrical circuit containing a power source and an alarm or call system existing in hospitals, for example. In another embodiment the sensor device of the present invention can be used to activate a transmitter for a limited range paging system whereby the sensor device can be used in a home application.

BRIEF DESCRIPTION OF THE DRAWINGS

For a fuller understanding of the nature and desired objects of the present invention, reference should be made to the following detailed description taken in conjunction with the accompanying drawings wherein like reference characters denote corresponding parts throughout several views and wherein.

DETAILED DESCRIPTION OF THE PREFERRED EMBODIMENT(S)

The present invention is adapted to be employed with a conventional call system such as a nurse call system or the like that may be provided in the rooms of a hospital, convalescent rooms or a home use or the like and provides a monitoring instrument for automatically indicating the movement of a patient, for example, in a bed or a chair. The principal feature of the present invention is the patient sensor device and the combination of the sensor device and a circuit system.

Figure 1:
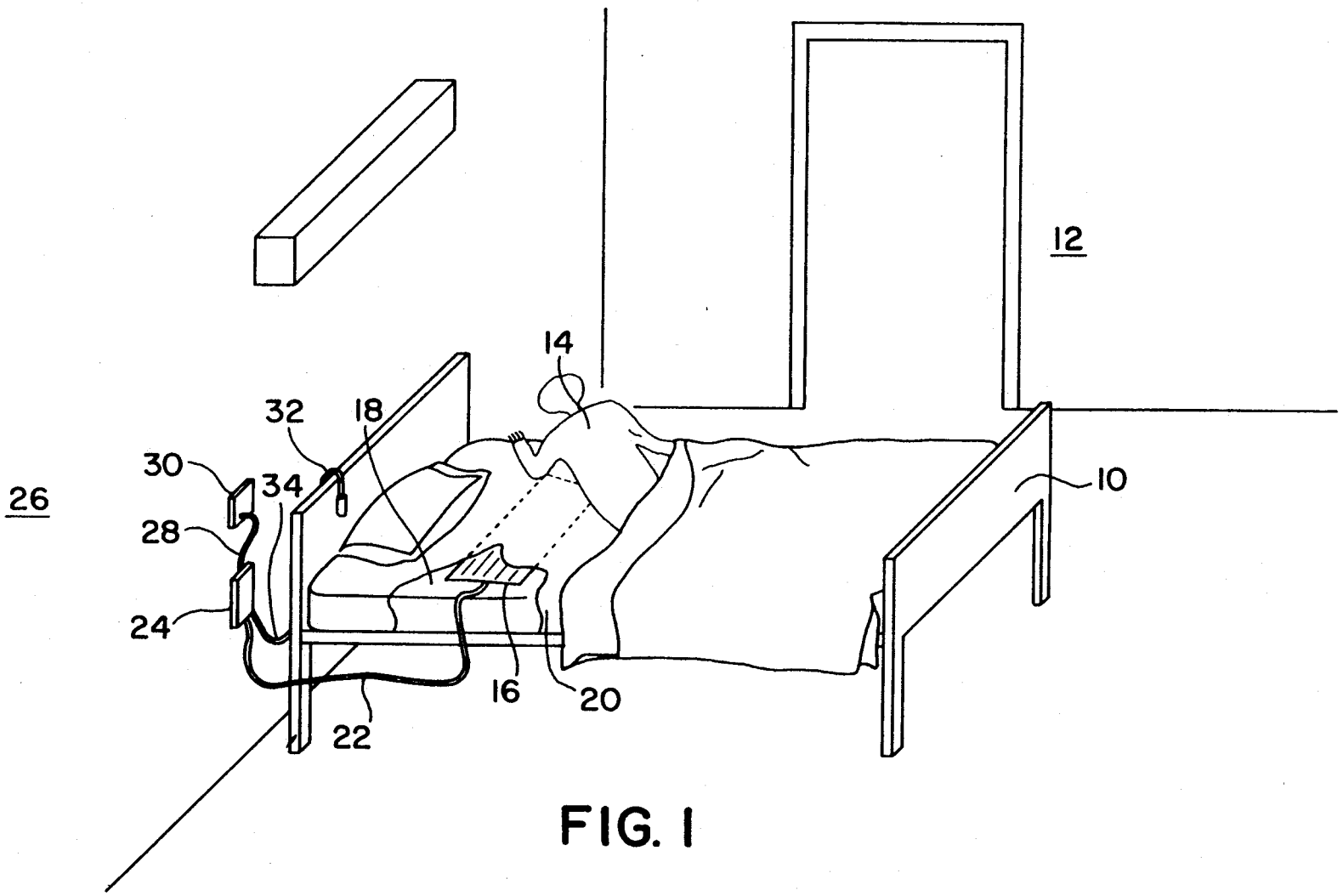
FIG. 1 is a fragmentary perspective view of an application of the sensor device of the present invention in a hospital and in connection with a conventional call system.

Referring now to FIG. 1, there is illustrated a hospital bed 10 in a room 12 with a patient 14 in the bed 10. A sensor device, illustrated generally by the numeral 16, is positioned on the mattress 18 under the sheet 20. The sensor device 16 is shown having an electric circuit path means 22 connected to the control circuit device 24 attached to the room wall 26 and which in turn is connected by the circuit path means 28 to an existing conventional call system 30 also attached to the wall 26. The control circuit device 24 also includes a conventional call button 32 attached thereto by the flexible wire 34.

Figure 2:
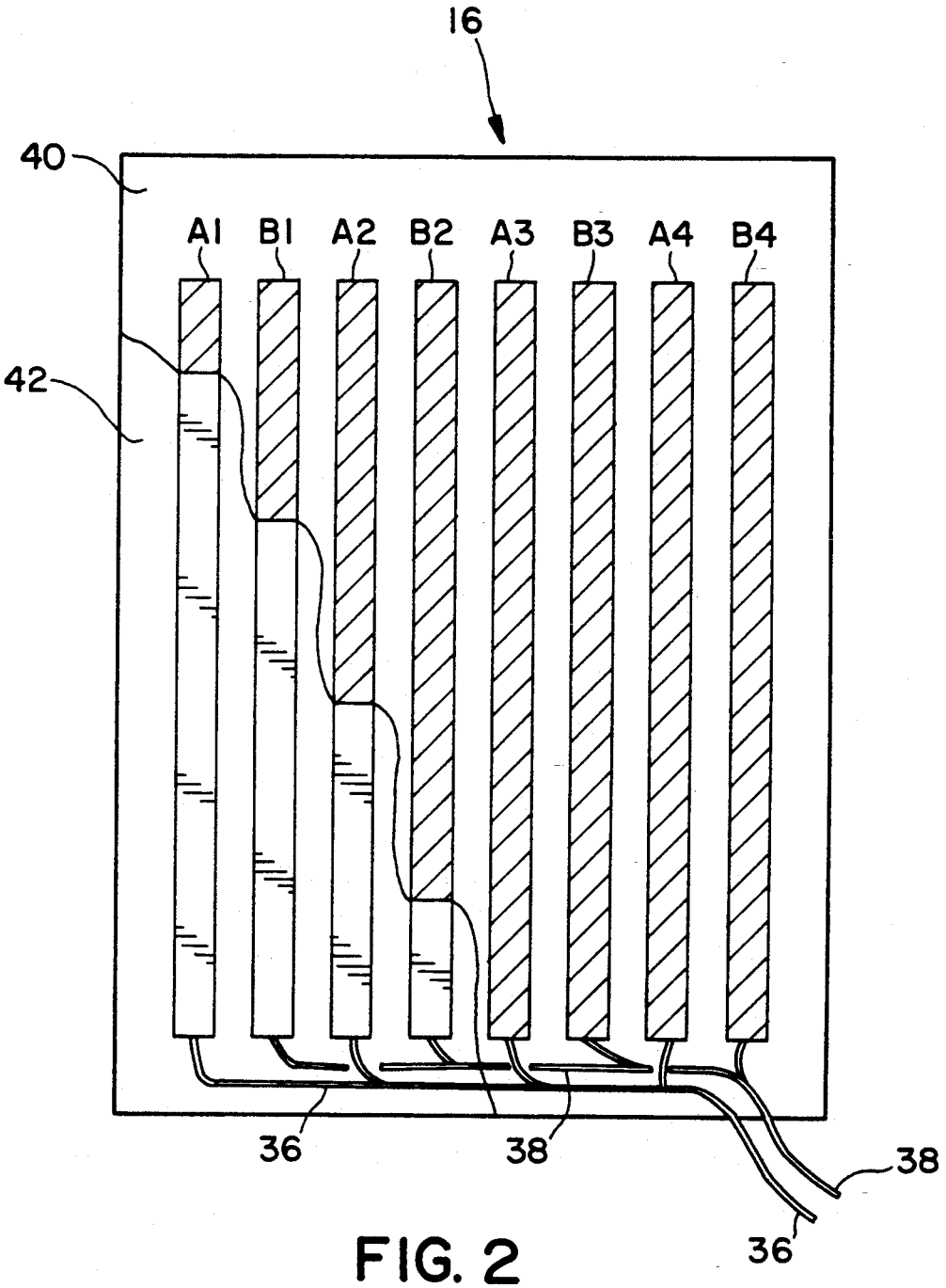
FIG. 2 is a fragmentary top plan view of the sensor device of the present invention.
Figure 3:
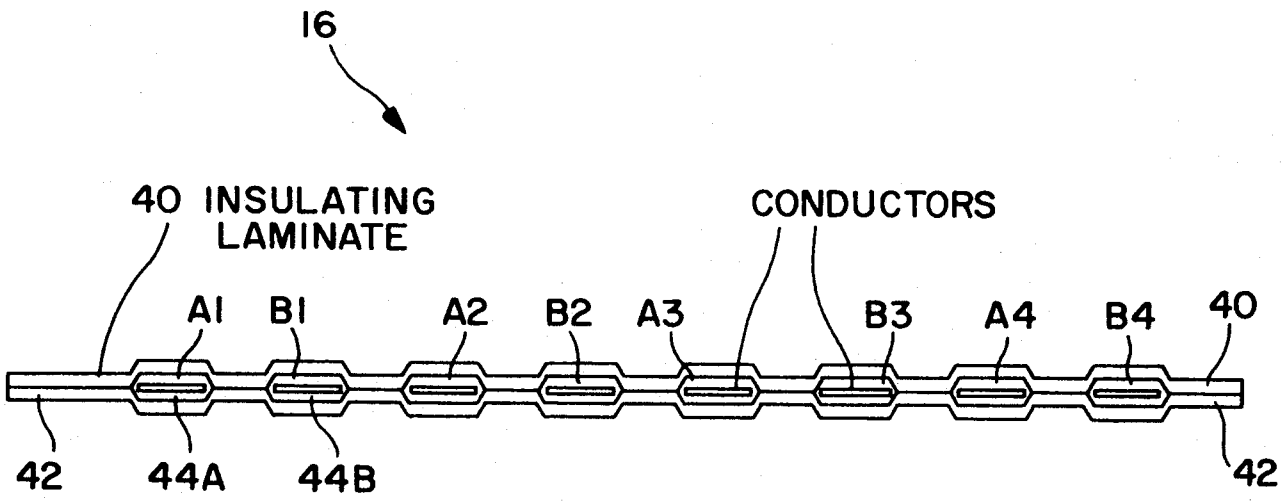
FIG. 3 is a cross-sectional view of a sensor device in accordance with the present invention.

Referring now more particularly to FIGS. 2 and 3, the capacitor sensor device 16 comprises two groups of parallel electrical conductors. The two groups of electrical conductors are groups A1–A4 and B1–B4. The electrical conductors of each group are arranged so that they alternate in parallel relationship to each other, such as A1–B1, A2–B2, and so forth, as illustrated. The parallel electrical conductors of group A1–A4 are all connected to the electric wire cable 36 and the alternating parallel electrical conductors of group B1–B4 are all connected to the electric wire cable 38 and thereby form two electrical connectors for the capacitor sensor device 16. The electrical conductors are each electrically insulated from each other and from the environment by upper and lower layers 40 and 42 of a plastic laminate material. Suitable plastic laminates include polyethylene and polypropylene.

The electrical insulation in accordance with the present invention provides improved operation of the capacitor sensor device 16 and the arrangement of the plastic laminate 40 and 42 also serves to maintain a fixed distance between the parallel conductors A1–A4 and B1–B4 and thereby provides an improved sensor device since it serves to maintain a selected fixed distance between the conductors and thereby minimizes variation in capacitance which results in mechanical distortion. It should be understood that the upper plastic laminate layer 40 and the lower plastic laminate layer 42 can be applied as a unitary structure. Additionally, it should be noted that the number of conductors illustrated in A1–A4 and B1–B4 can be varied in accordance with the present invention. The sensor device 16 of the present intention provides a comfortable, thin, flexible sheet sensor device 16 that can be conveniently placed under a patient as illustrated in FIG. 1 as an example of use. Also the construction and arrangement of the sensor device 16 of the present invention permits it to be made with a thickness of 0.02 inches or to a selected increase in thickness. The new and improved arrangement of the sensor device 16 of the present invention can be varied with respect to the number of conductors A and B, the cross-sections 44A and 44B (as shown in FIG. 3) of the conductors A and B, the length and width of the sensor device 16, the interconnection of the conductors A and B, the type and dimension thickness of the plastic laminate material 40 and 42, can be easily varied for a particular application of the sensor device 16.

Figure 4A:
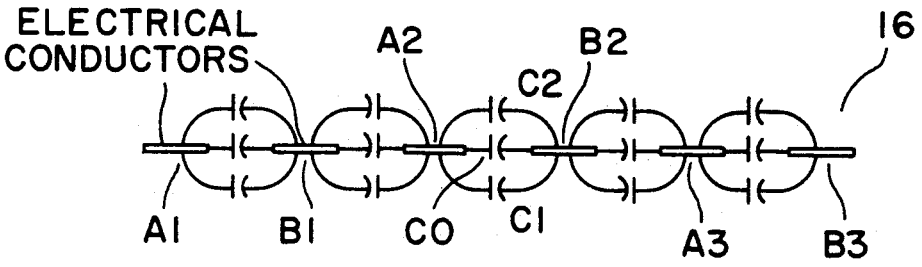
FIG. 4A is a cross-sectional schematic diagram of a section of the sensor device without patient weight thereon.
Figure 4B:
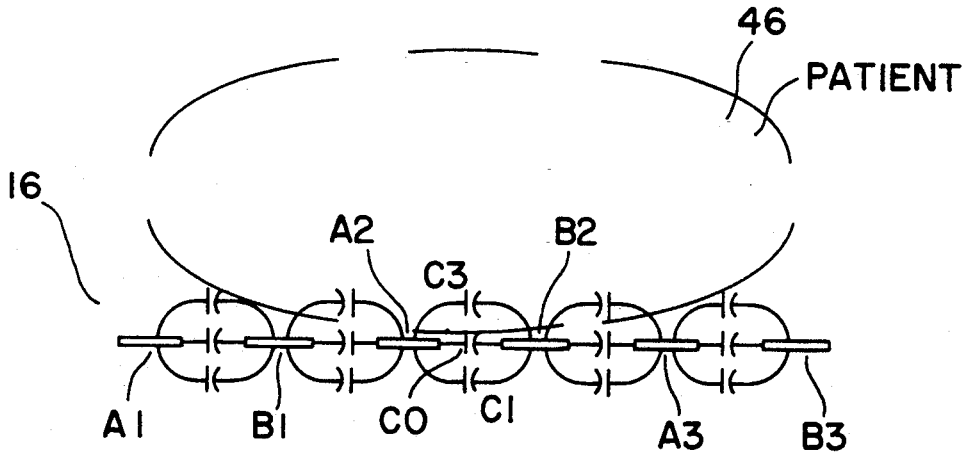
FIG. 4B is a cross-sectional schematic diagram of a section of the sensor device with patient weight thereon.

Referring now more particularly to FIGS. 4A and 4B, the sensor device 16 of the present invention processes by correlating a change in the capacitance with the movement of the patient (as shown in FIG. 1). When the sensor device 16 is placed on the bed 10 without a patient 14, a reference value of the capacitance can be measured between two electrical conductors (A2 and B2, for example) of the capacitor sensor device 16. As illustrated in FIG. 4A, the capacitance value would be in Farad symbols C0+C1+C2 for the two conductors A2 and B2.

As shown in FIG. 4B, when the patient, illustrated by FIG. 46, lies upon the capacitor sensor device 16, such as in a bed as illustrated in FIG. 1, when the capacitance is measured between two conductors, A2 and B2, for example, the sensor device 16 will increase to a second level shown by the symbols C0+C1+C3. The circuitry described hereinafter will indicate the difference in capacitance (C3–C2) between FIG. 4B and FIG. 4A. If the patient moves away from the sensor device 16 the capacitance will return to that of FIG. 4A.

Figure 5:
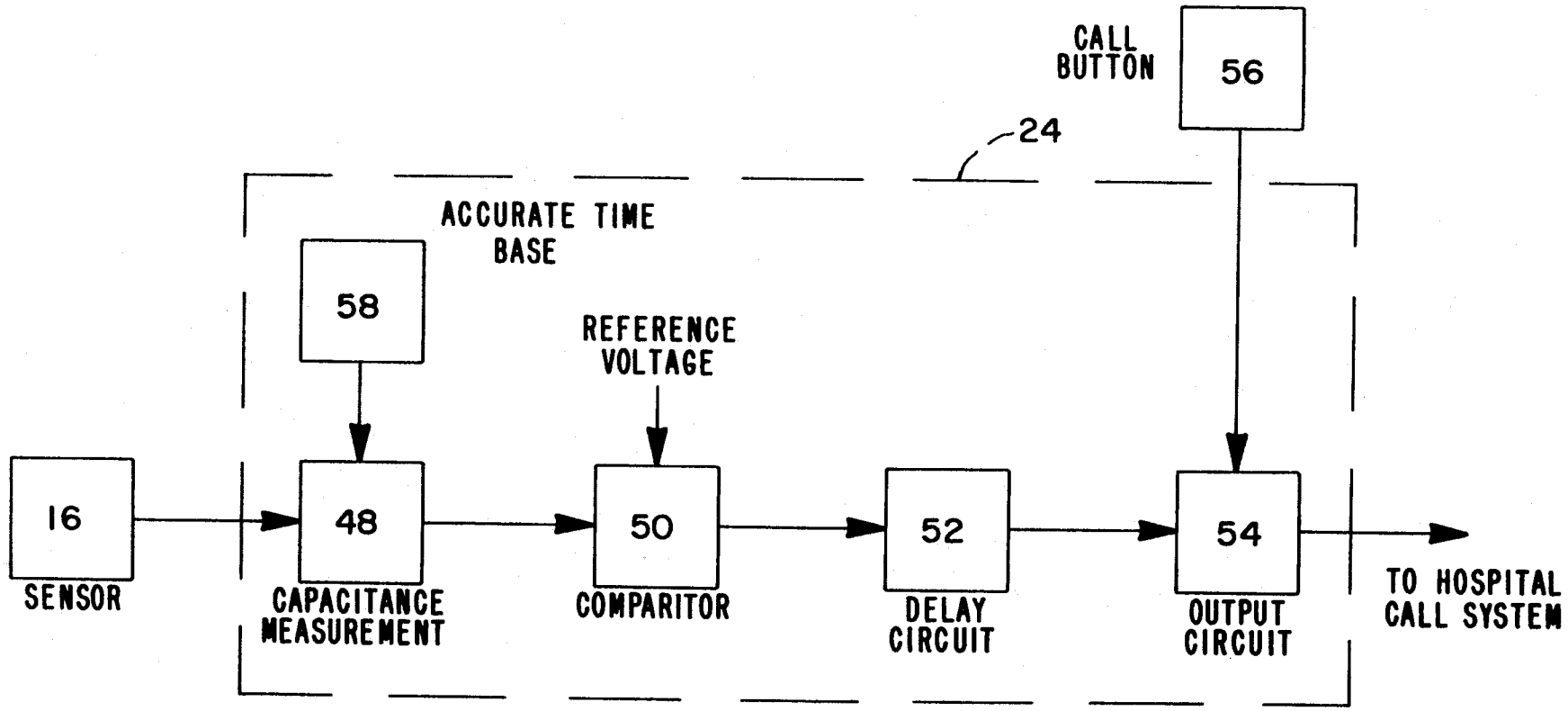
FIG. 5 is a schematic illustration of a circuit diagram showing the monitoring system of the present invention.
Figure 6:
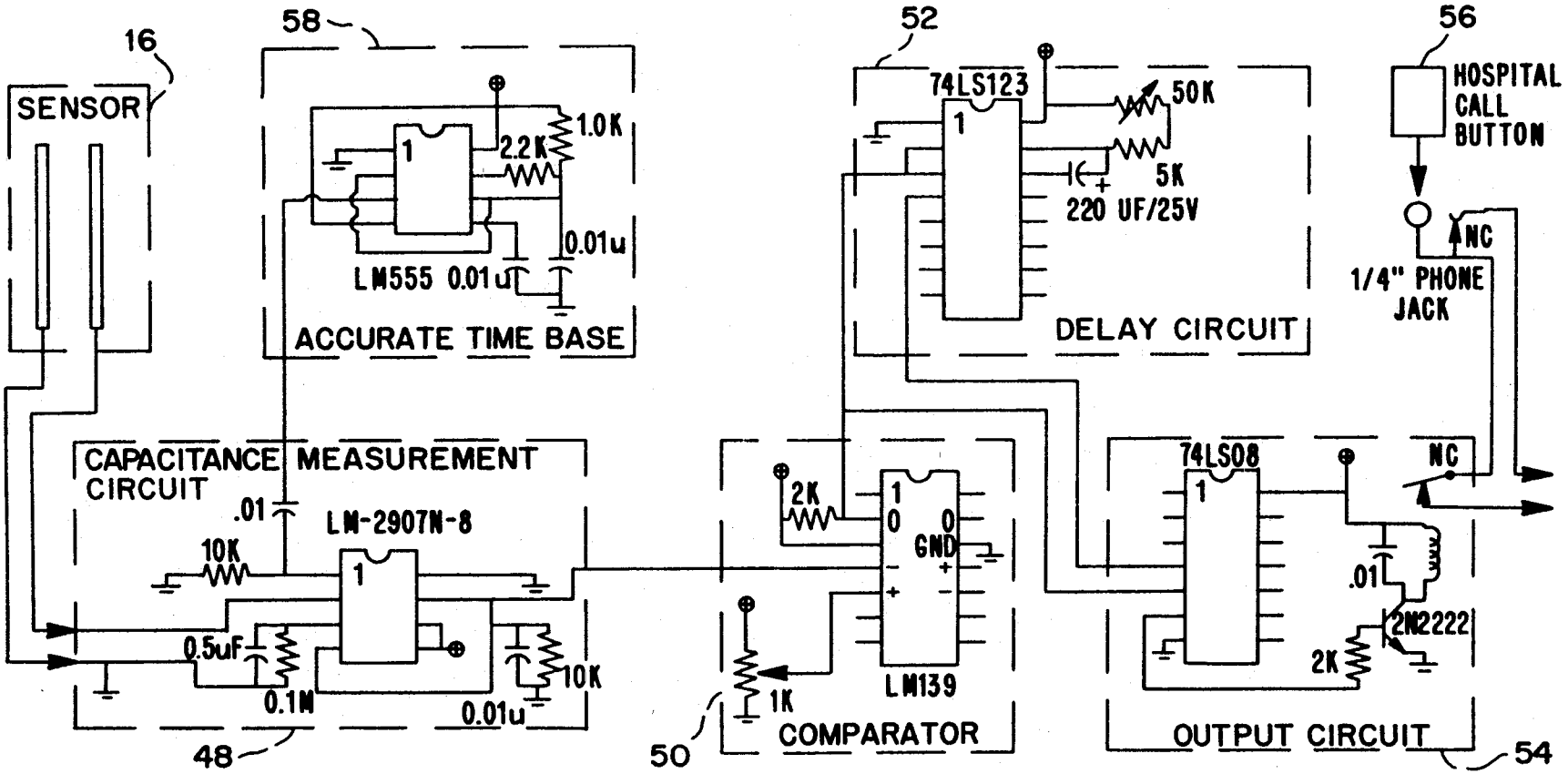
FIG. 6 is a schematic illustration of a circuit diagram showing a patient monitoring system embodying the present invention.

Referring now to FIGS. 5 and 6 (in which the same reference numerals are used to identify the same components), there is illustrated respectively a block diagram (FIG. 5) and a schematic drawing (FIG. 6) of a circuit diagram in which the sensor device 16 of the present invention is combined to provide a patient movement monitoring circuitry device shown as 24 in FIG. 1.

The circuit device comprises the capacitance measuring circuit 48, a reference voltage caparitor 50, a delay circuit 52, an output circuit 54, a call button 56 and an accurate time base member 58. The capacitance measurement circuit 48 provides a voltage that is proportional to the value of capacitance presented at its input terminals. To prevent false activation of the call system, the voltage that is generated by capacitance measurement circuit 48 must accurately represent the capacitance of the sensor device 16, independent of variables such as temperature and battery condition. The capacitance circuit 48 also has sufficient sensitivity to measure the low levels of capacitance that the sensor device 16 presents such as, for example, 20 to 100 pico farads. The output of the capacitance measurement circuit 48 is an analogue voltage, i.e. it can assume any value between two levels.

The function of the comparitor 50 is to convert the analogue voltage to a digital voltage, which in this embodiment is either 0 or 5 volts. This is accomplished by comparing the voltage from the capacitance measurement circuit 48 with an internal reference voltage comparitor 50. When the capacitance of the sensor device 16 changes such that the voltage associated with it goes above (or below) the reference voltage level, the output of the comparitor 50 will change from 5 to 0 volts (or 0 to 5 volts).

Both the capacitance measurement circuit 48 and the comparitor 50 respond instantaneously to a change in capacitance at the sensor device 16. As the patient moves about the bed in normal activity, there will be momentary fluctuations in the measured capacitance until the patient settles down again. These fluctuations would produce a "chattering" of the 0 and 5 volt signals as the output of the comparitor 50. The delay circuit 52 prevents these variations from falsely triggering the conventional hospital call system. This is done by insuring that the capacitance has been in the low state for a specified period of time before activating the output circuit 54. The period of time is adjustable by the operator from 1 to 8 seconds or longer, as predetermined.

In the output circuit 54, a relay device is used to convert the 0 and 5 volt signal to either a closed or open circuit required by the hospital call system. The relay output circuit 54 also provides isolation between the monitoring circuitry as discussed with respect to FIGS. 5 and 6 and the electronics of the hospital call system.

While the invention has been described with respect to preferred embodiments, it will be apparent to those skilled in the art that changes and modifications may be made without departing from the scope of the invention herein involved in its broader aspects. Accordingly, it is intended that all matter contained in the above description, or shown in the accompanying drawing shall be interpreted as illustrative and not in limiting sense.

As our invention we claim:

1. A capacitor sensor device for use in conjunction with a monitoring circuit system and call alarm system to perceive a patient movement, said capacitor sensor device comprising:

a plurality of elongated electrical conductor means positioned in horizontal parallel spaced relationship;

an electrical insulating material forming an upper layer and lower layer over and about each electrical conductor means whereby said conductor means are maintained in insulated parallel spaced relationship to each other, said electrical conductor means being connected to electrical conductive connectors.

2. The capacitor sensor device according to claim 1 wherein said electrical insulating material is flexible plastic.

3. The capacitor sensor device according to claim 2 wherein said flexible plastic has a thickness of approximately 0.02 inches.

4. A monitoring system for bed and chair patients comprising:

a capacitor sensor device comprising a plurality of elongated electrical conductor means positioned in horizontal parallel spaced relationship, an electrical insulating material forming an upper layer and lower layer over and about each electrical conductor means whereby said conductor means are maintained in insulated parallel spaced relationship to each other, said electrical conductor means being connected to electrical conductive connectors;

a capacitance measurement circuit means connected to the electrically conductive connectors of the capacitor sensor device;

a reference voltage comparitor means connected in an electric circuit with said capacitance measurement circuit means;

a delay circuit means connected in an electric circuit with said reference voltage comparitor means; and an output circuit means connected in an electrical circuit with said delay circuit means.

5. A monitoring system according to claim 4 wherein the electrical insulating material is a plastic laminate material.

6. A monitoring system according to claim 4 wherein the electrically conductive connectors for the plurality of elongated electrical conductor means comprises two electrical conductors each connecting to alternate elongated electrical conductor means.

7. A monitoring system according to claim 4 wherein said output circuit means additionally includes means to produce a call signal when selected characteristics occur in said output signal of the capacitor sensor.

8. A monitoring system according to claim 4 wherein said comparitor means includes means to convert analogue voltage to digital voltage.

9. A monitoring system according to claim 4 wherein said capacitance measurement circuit means produces a voltage that is proportional to the value of capacitance received from the capacitor sensor device.

10. A monitoring system according to claim 4 including means for connecting the monitoring system to a power supply.

11. A capacitor sensor device for use in conjunction with a monitoring circuit system and call alarm system to perceive a patient movement, said capacitor sensor device comprising:

a plurality of elongated electrical conductor means positioned in horizontal parallel spaced relationship;

an electrical insulating flexible plastic material forming an upper layer and lower layer over and about each electrical conductor means whereby said conductor means are maintained in electrically insulated parallel spaced relationship to each other, and electrical conductive connector means comprising two electrical connector means each connected to alternate parallel elongated electrical conductor means.

12. A monitoring system for bed and chair patients comprising:

a capacitor sensor device comprising a plurality of elongated electrical conductor means positioned in horizontal parallel spaced relationship, an electrical insulating flexible plastic material forming an upper layer and lower layer over and about each electrical conductor means whereby said conductor means are maintained in electrically insulated parallel spaced relationship to each other, and electrical conductive connector means comprising two electrical conductor means each connected to alternate parallel elongated electrical conductor means;

a capacitance measurement circuit means connected to the electrical conductor connectors of the capacitor sensor device;

a reference voltage comparitor means connected in an electric circuit with said capacitance measurement means;

a delay circuit means connected in an electric circuit with said reference voltage comparitor means; and an output circuit means connected in an electrical circuit with said delay circuit means.

* * * * *